US005623298A

United States Patent [19]

Motoyama et al.

[11] Patent Number: 5,623,298

[45] Date of Patent: Apr. 22, 1997

[54] GLAZED LAYER FOR A THERMAL PRINT HEAD

[75] Inventors: Kunio Motoyama; Masatoshi Nakanishi; Takaya Nagahata; Hiroaki Onishi, all of Kyoto, Japan

[73] Assignee: Rohm Co., Ltd., Kyoto, Japan

[21] Appl. No.: 268,051

[22] Filed: Jun. 29, 1994

[30] Foreign Application Priority Data

Jun. 30, 1993 [JP] Japan ..... 5-162765

[51] Int. Cl.[6] ..... B41J 2/335

[52] U.S. Cl. ..... 347/202

[58] Field of Search ..... 346/76 PH; 347/202

[56] References Cited

U.S. PATENT DOCUMENTS 4,476,377 10/1984 Tatsumi et al. ..... 346/76 PH
4,707,708 11/1987 Kitagishi et al. ..... 346/76 PH
4,743,923 5/1988 Nishiguchi et al. ..... 346/76 PH
5,014,135 5/1991 Ijuin et al. ..... 346/76 PH

*Primary Examiner*—Huan H. Tran
*Attorney, Agent, or Firm*—Fish & Richardson P.C.

[57] ABSTRACT

In a thermal print head, a partial glazed layer has a width of 0.1 to 0.4 mm and a height of 15 to 25 μm. With the partial glazed layer of this size, since the amount of accumulated heat is reduced, no trailing phenomenon would arise so as to improve the printing quality. It is also advantageous that no defective product will be manufactured because the glazed layer is not too small, with less energy consumption. As a result, a high-quality printing operation can be maintained even during such high-speed printing as not exceeding 1 ms per one line.

8 Claims, 9 Drawing Sheets
(4 of 13 Drawing(s) in Color)

PRESENT EMBODIMENT

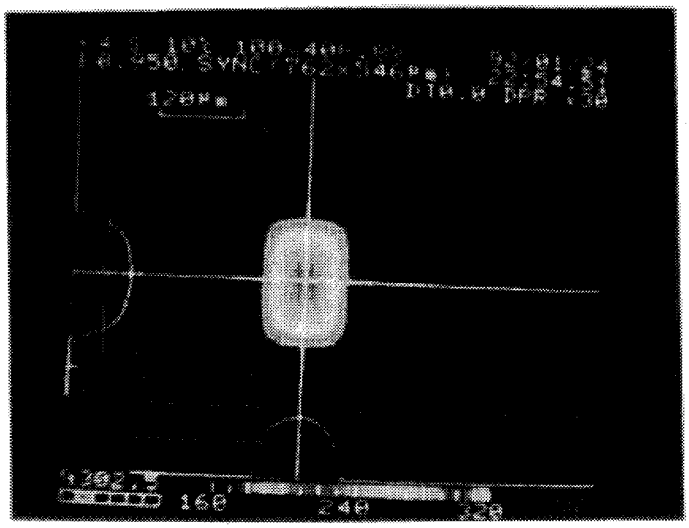
Fig. 4(a) PRIOR ART
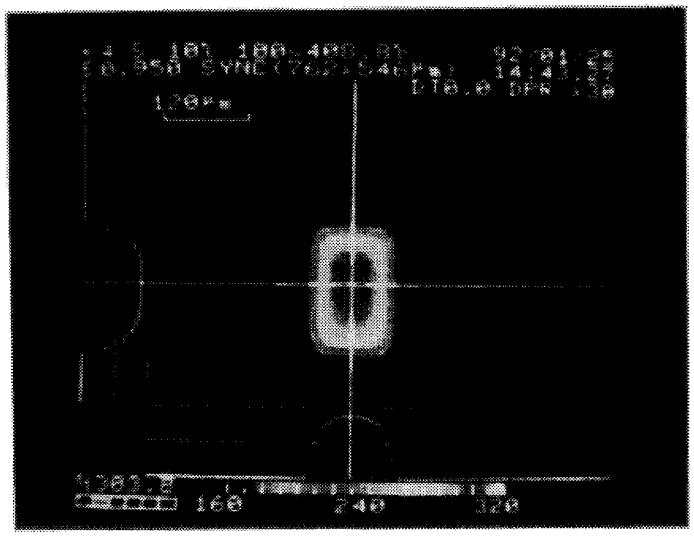
Fig. 4(b) PRESENT EMBODIMENT

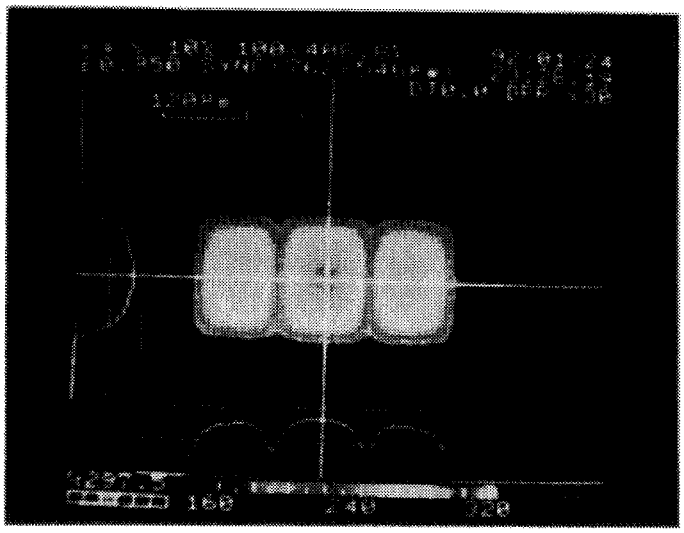
Fig. 5(a) PRIOR ART
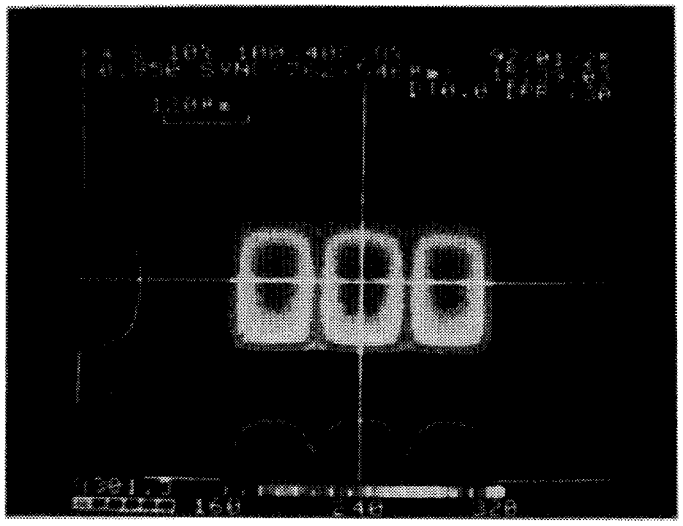
Fig. 5(b) PRESENT EMBODIMENT

Fig.8(b) PRESENT EMBODIMENT

GLAZED LAYER FOR A THERMAL PRINT HEAD

BACKGROUND OF THE INVENTION

1. Field of the Invention

The present invention relates to a thermal print head, and more particularly to a thermal head having an improved glazed layer for enhancing printing efficiency and also to a printing device equipped with the same.

2. Description of the Related Art

A thermal print head generates heat in response to supplied driving current to perform printing on a heat sensitive sheet. In this case, it is general to provide a glazed layer beneath a heat generating resistor as a heat accumulating layer, due to a large heat dissipation capacity of a ceramic substrate.

The glazed layer acts to prevent the heat from dissipating so as to improve the energy efficiency. Without this glazed layer, an excessively large amount of energy would be required to sufficiently heat the head in order to start printing, resulting in significantly poor energy efficiency. If the glazed layer is too large, however, the heat dissipation capacity would become deteriorated so as to prevent the once heated printing section (heat generating section) from quickly cooling. As a result, this residual heat causes a tailing phenomenon.

In this manner, while the glazed layer in a thermal head acts as a heat accumulating layer to improve the energy efficiency, it may also lead to lowering of the printing quality. The shape and size of the glazed layer play important roles and should be determined in view of the relationship to the energy efficiency and the printing quality.

It has been impossible, however, to perform the printing operation at a speed higher than approximately 3 msec which is the cooling time of the conventional print head. For increasing the printing speed, so-called heat history control has been used, in which the heat generating amount is varied by adjusting the printing energy in view of printing data stored in a memory. Even with this control, however, the critical recording speed is approximately 0.8 msec, at which speed it is not easy to carry out printing with high quality.

Thus, in the conventional printing device provided with such a type of thermal print head, the printing quality was not sufficient in the case of high speed printing. High speed printing of bar codes, for example, would easily result in insufficient printing of bars, leading to reading errors.

SUMMARY OF THE INVENTION

It is therefore an object of this invention to provide a thermal print head which is capable of performing high-quality printing at high speed and is suitable for the printing of bar codes and the like.

In view of this object, a thermal print head according to the present invention comprises a conical partial glazed layer having an width in the range of 0.1–0.4 mm and a height of its vertex being in the range of 15 μm–25 μm.

This invention is based on an experiment for calculating the amount of energy capable of providing a saturated density by varying the partial glazed layer in a range of 12 μm–28 μm. As a result of this experiment, it has been found that almost the same printing quality can be obtained with a similar amount of energy, if the partial glazed layer is in a range of 15–25 μm. Namely, if it is intended just to reduce the cooling time in order to prevent the tailing phenomenon, the closer the volume of the glazed layer to zero, the better. But since the reduction of the volume proportionally relates to the increase of the energy required for printing, it is impractical for actual products. Further, reducing the volume would cause an increase in the number of defects of the glazed layer under the influence of the ceramic substrate having an irregular surface, so as to make the manufacturing processes difficult. Meanwhile, however, if the dimension of the glazed layer is set to the range mentioned above, such problems would not arise, providing desirable printing quality with almost the same energy as in the conventional apparatus even during the high-speed printing process.

Accordingly, a printing apparatus having such a glazed layer, as a matter of course, can be realized as a practical product, and further can provide more excellent printing quality than the conventional printing apparatus.

In the thermal head according to this invention having the partial glazed layer with the aforementioned range of dimensions, the saturated state can quickly arise with almost the same energy as in the conventional apparatus and less cooling time for the heat generating section (printing section). As a result, any tailing phenomenon due to the residual heat would not appear. On the other hand, since the saturated state quickly appears with almost the same amount of energy as in the conventional apparatus, the energy required for the printing operation is almost the same as in the conventional apparatus, and there would be a lower number of defects of the glazed layer generating during the manufacturing processes, greatly contributing to provide practical products.

BRIEF DESCRIPTION OF THE DRAWINGS

The file of this patent contains at least one drawing executed in color. Copies of this patent with color drawings will be provided by the Patent and Trademark Office upon request and payment of the necessary fee.

FIG. 4(*a*) is a graph showing a result of observation of the temperature distribution via a thermo graph at the time of heat generation in the conventional thermal head, and FIG. 4(*b*) is a graph showing a result of observation of the temperature distribution via a thermo graph at the time of heat generation in a thermal head of this embodiment;

FIG. 5(*a*) is a graph showing a result of observation of the heat-generation distribution via a thermo graph at the time of heat generation of a conventional thermal head having a plurality of dots, and FIG. 5(*b*) is a graph showing a result of observation of the heat-generation distribution via a thermo graph at the time of heat generation of a thermal head according to a present embodiment having a plurality of dots;

DETAILED DESCRIPTION

Figure 1:
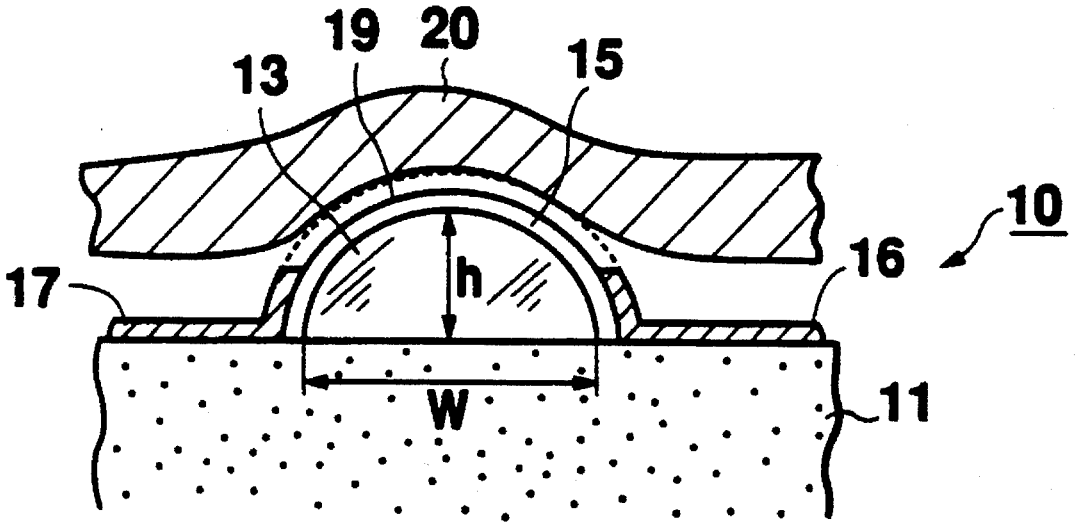
FIG. 1 is a cross-sectional view showing a composition of a thermal head according to a preferred embodiment of this invention.

FIG. 1 is a cross-sectional view showing a structure of a thermal print head according to a preferred embodiment of this invention.

Figure 9:
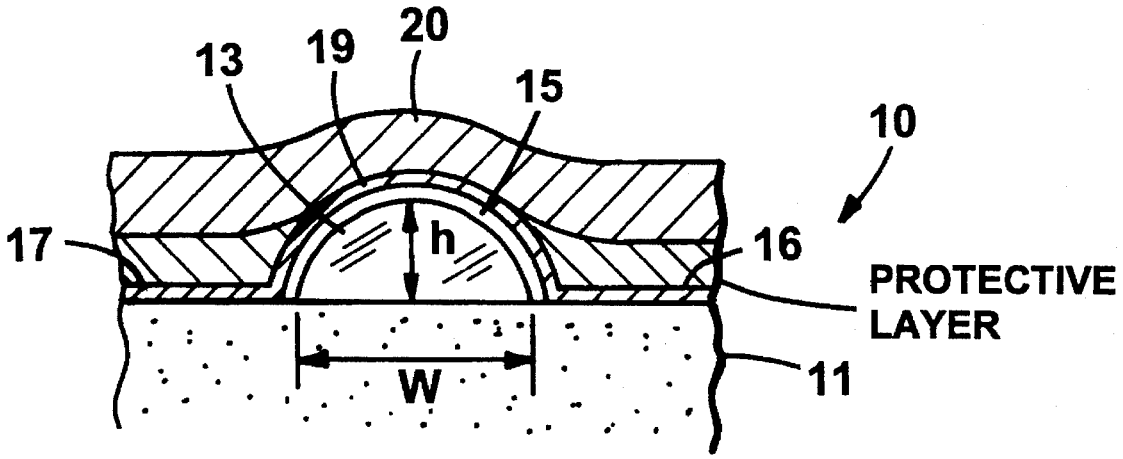
FIG. 9 is a cross-sectional view showing a composition of a thermal head according to a preferred embodiment of this invention.

A thermal print head 10 comprises a ceramic substrate 11 and a glass-type partial glazed layer 13 being printed and baked on the substrate 11. The partial glazed layer 13 is covered with a heat generating resistor 15 on which a common electrode 16 and a discrete electrode 17 are formed to cover it. The part where the heat generating resistor 15 is exposed without being covered with the common electrode 16 and the discrete electrode 17 constitutes a heat generating section 19. The heat generating section 19 generates heat to perform a printing operation upon contacting with a heat sensitive sheet 20. The heat generating resistor 15, the common electrode 16 and the discrete electrode 17 are made by evaporation or sputtering. A protective layer covering the common electrode, the discrete electrodes and the heat generating section is provided to protect these elements, as shown in FIG. 9. The heat generating resistor 15 is made of a variety of resistance materials such as nickel-chrome etc. The glass-type partial glazed layer 13 has a conical cross-section which has a strong pressing force so as to enable excellent printing even on rough quality sheet.

As a significant feature of this embodiment, the width w of the glazed layer is set to a value in a range of 0.1–0.4 mm, and at the same time its height h is set to a value in a range of 15 μm–25 μm. When the width w and the height h of the glazed layer 13 are selected to such a range, the factors such as printing energy, sharpness of printing, printing speed and ease of manufacture become significantly improved.

The partial glazed layer 13 formed beneath the heat generating section 19 contributes to improve the heat generating efficiency, but also becomes a factor of lowering the printing quality. The setting of the shape and the magnitude of the glazed layer is an important point to be determined in view of the relationship to the energy efficiency and the printing quality. Therefore, it is necessary to establish an ideal range for them, taking the cooling characteristics after heat generation and the printing speed, into account. The present inventor has carried out a variety of experiments for obtaining this ideal range, reaching the following conclusions.

Namely, when the height h of the vertex of the glazed layer 13 is equal to or more than 25 μm and its width w is equal to or more than 0.4 mm, there would arise a tailing phenomenon due to the residual heat impeding desired printing, so as to cause reading errors when the bar codes are printed at a high speed (no more than 1 msec for one line). Meanwhile, if the height h is no more than 15 μm and the width w is no more than 0.1 mm, the energy consuming amount would significantly be increased, and the number of defects such as pin holes would be increased due to the irregularity of the surface of the ceramic substrate so as to make the manufacture of the product difficult. If the glazed layer 13 is established at the range found by this inventor, however, such problems can be solved so as to provide quite desirable characteristics.

(1) Temperature Characteristics

Figure 2:
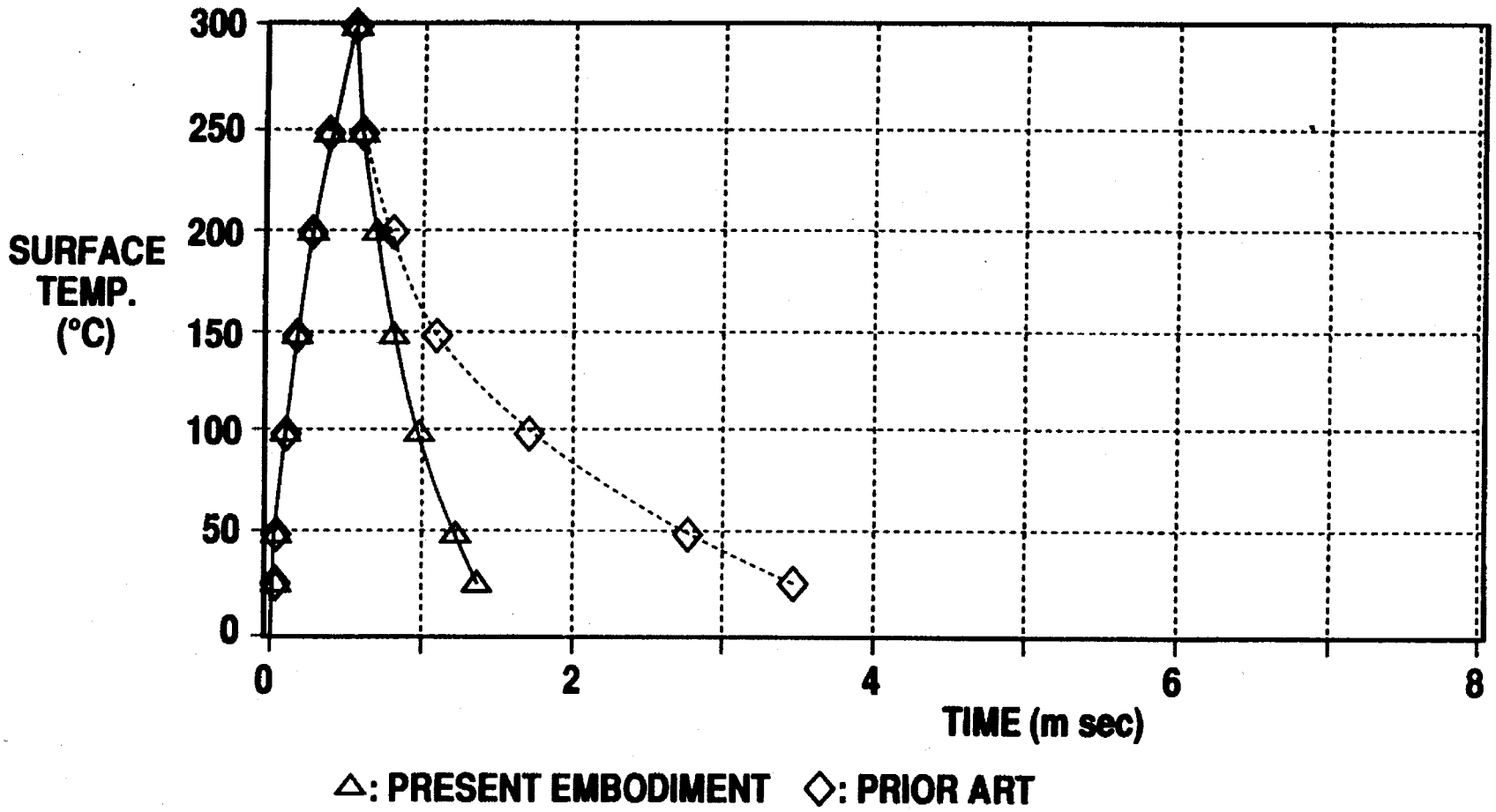
FIG. 2 is a graph showing a result of an experiment on the temperature (temperature falling) characteristics of a thermal head according to this invention.

FIG. 2 shows a result of an experiment on the temperature characteristics of the thermal head of this invention and a conventional one. In this experiment, what was investigated was the temperature falling characteristics, after pulses of 0.51 msec are applied to cause the surface temperature of both thermal heads to become 300° C., when the thus heated heads are naturally cooled. The voltage and the current were appropriately adjusted to make the surface temperature of the heads be 300 degrees. In this embodiment, the height h of the glazed layer of the thermal head is 20 μm and the width w is 350 μm. In the conventional thermal head, the height h of the glazed layer h is 50 μm and the width w is 1000 μm.

As clearly seen from FIG. 2, while the thermal head of the present embodiment takes approximately 1.3 msec to fall to room temperature, the conventional thermal head takes approximately 3.5 msec for the same. Therefore, when the heat generating section 19 is heated to a high temperature for clear printing or when the moving speed of the head is increased for quick printing, the conventional thermal head would cause the tailing phenomenon, while the thermal head of this embodiment would not be subject to such a disadvantage. In other words, the thermal head of this invention would enable a quick and clear printing operation.

Figure 3A:
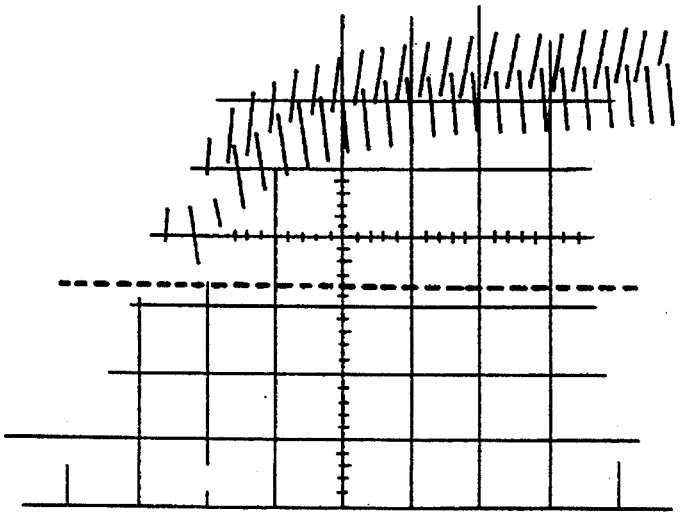
FIG. 3(a) PRIOR ART
FIG. 3(*a*) is a graph showing a result of an experiment on the temperature characteristics when continuous pulses are applied to a conventional thermal head, and FIG. 3(*b*) is a graph showing a result of an experiment on the temperature characteristics of a thermal head of this embodiment when continuous pulses are applied.
Figure 3B:
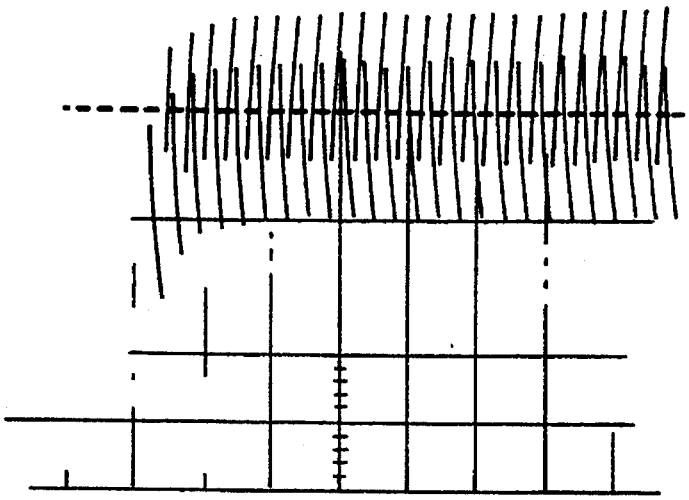

FIGS. 3(*a*) and 3(*b*) show characteristics when continuous pulses are applied.

The maximum temperature and the minimum temperature would become almost constant by continuous pulse application. Such a state is called a saturated state. In a thermal head, an excellent printing operation can be attained in this saturated state. In other words, without the saturated state, fine printing quality cannot be obtained. Therefore, rapid start up, and quickly reaching the saturated state are important points in determining the performance of the thermal head.

As shown in FIG. 3(*b*), in the thermal head of this embodiment, saturation is reached at the fifth pulse and start up is exceptionally good. Meanwhile, in the conventional thermal head, it is worse than that of this embodiment because saturation is not reached until the 11th pulse. Thus, according to the thermal head of this embodiment, upon the application of the pulses the maximum and minimum temperatures quickly become stable. As a result, in comparison with the conventional apparatus, it is possible to perform the printing with high quality and an extremely short time after the starting of the device.

In the experiment shown in FIGS. 3(*a*) and 3(*b*), the pulse width is set to 0.3 msec with the pulse period being 0.62 msec respectively. The current and the voltage are set to make the maximum temperature be 300° C. In the normal heat sensitive sheet, the static coloring characteristics are approximately 70° C., so that the coloring appears at about 70° C. when the head is static. To attain sufficient coloring to read with the head (or the heat sensitive sheet) moving, however, it is necessary to heat the thermal head until it reaches approximately 200° C. In view of this, according to the conventional thermal head, the coloring characteristics of the heat sensitive sheet would not be desirable at the initial state. On the other hand, according to the thermal head of this embodiment, it is possible to carry out clear printing on the heat sensitive sheet from the start of the printing.

In this manner, using the thermal head according to this embodiment, it is possible to perform clear printing by quick temperature falling (FIG. 2) and to perform clear printing from the start of the printing by quickly starting up and dropping the temperature so as to quickly reach the saturated state when pulses are applied (FIG. 3(*b*)).

(2) Heat Generating Distribution

FIGS. 4(*a*) and 4(*b*) show the results of observation of heat generating distribution of the thermal heads according to this invention and conventional apparatus using a thermo graph. The thermal heads shown in FIGS. 4(*a*) and 4(*b*) are set to single dot with the pulse width to be applied being 0.5 msec. As shown in these FIGS., the heat generating sections (colorless section) are concentrated at the central portion in the conventional thermal head (FIG. 4(*a*)), while in the thermal head of this embodiment (FIG. 4(*b*)) the heat generating sections are not concentrated and are more uniformly dissipated. If the heat generating sections are concentrated, the thermal head would tend to be broken due to the high temperature of the concentrated portion. According to the thermal head of this embodiment, there would not arise such concentration of the heat generating section, so that it is not so easily broken as the conventional thermal head. The thermal head according to this embodiment has a lower volume of the glazed layer than in the conventional thermal head, but this reduction does not mean any reduction of the heat generating area, as is clearly understood from the aforementioned result of the experiment. In actual fact, reducing the glazed layer acts rather to expand the heat generating area.

(3) Effect of the Peripheral Dots

FIGS. 5(*a*) and 5(*b*) show a result of observation, of temperature distribution when a 3-dot thermal head is heated by applying pulses of 0.5 msec thereto, by use of a thermo graph. In these FIGS., the higher the density of the shadow, the higher the temperature. On the horizontal and vertical axes, the value of the temperature is represented by lines.

As shown in FIGS. 5(*a*) and 5(*b*), while three dots are uniformly heat generating in the thermal head of this embodiment (FIG. 5(*b*)), in the conventional thermal head (FIG. 5(*a*)) only the central one of the three dots is more heated than the other two. This is because in the conventional thermal head, the large heat accumulating amount of the glazed layer causes the dots neighboring the central dot to be over-heated, while in the thermal head of this embodiment since the glazed layer is quickly cooled to prevent residual heat as much as possible, so that the neighboring dots are left unaffected by the heat. In this manner, according to the thermal head of this embodiment, the larger the number of the dots, the more uniform printing over the whole sheet can be attained. Thus, the thermal head according to this embodiment can be used in a variety of printing apparatuses which set the dots.

(4) Printing Apparatus

Figure 6:
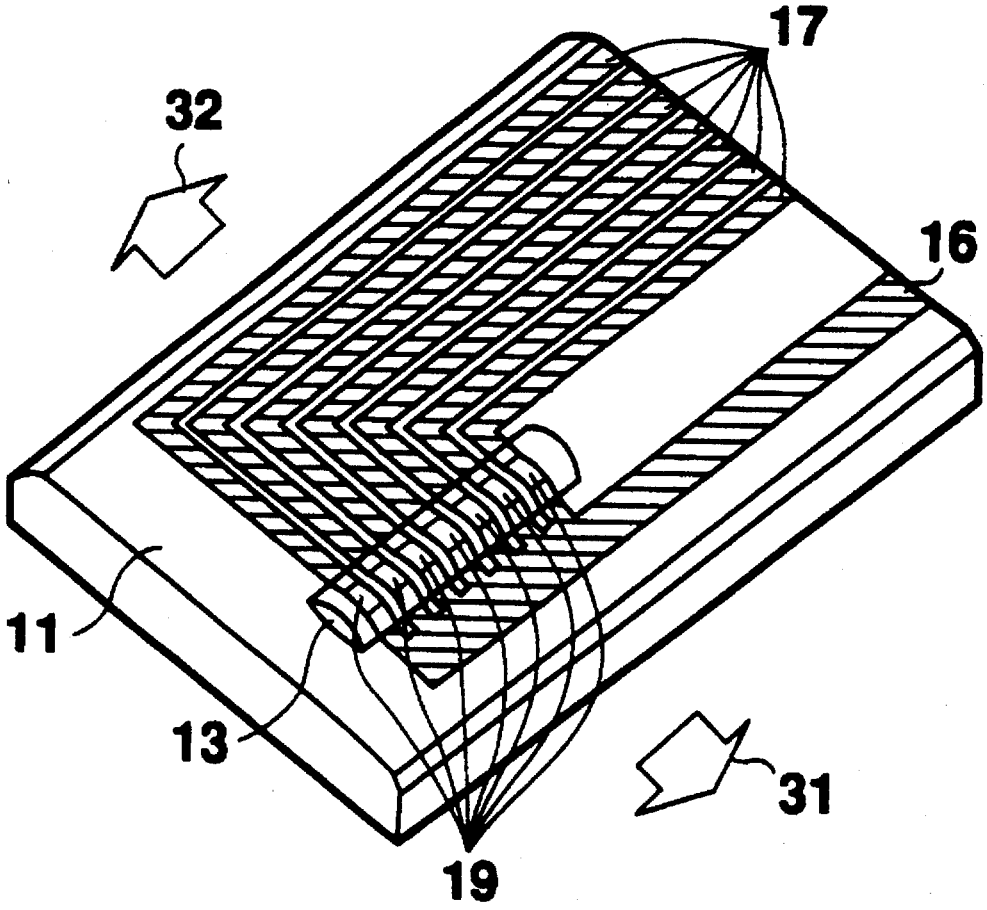
FIG. 6 is a perspective view of essential parts of a printing apparatus equipped with a thermal head according to this embodiment.

FIG. 6 is a schematic perspective view showing an outline of a thermal head according to this embodiment. In this thermal head, heat generating dots are formed along a surface layer plane of a conical glazed layer, which is preferable for line printers.

In FIG. 6, a ceramic substrate 11 is generally formed in square shape in view of assembling and processing convenience. The thermal head moves in the direction shown by an arrow 32 or 31. At this time, the printing is performed by heating a heat generating section 19 appropriately. In this embodiment, there are provide seven heat generating sections (seven dots). In a printing apparatus equipped with such a type of thermal head, as already described, the high-speed printing can be desirably carried out. Specifically, in the thermal head according to this invention, since the cooling time is approximately 0.5–0.8 msec, about one-third of the conventional one, it is possible to perform clear printing at such a high-speed as three times that in the conventional apparatus. Therefore, even when thermal history control is not carried out, it is possible to perform the printing at a speed higher than 1.1 msec, while in the case of performing the thermal history control an excellent printing with a recording speed higher than about 0.3 msec can be carried out.

(5) Printed Sample

Figure 7:
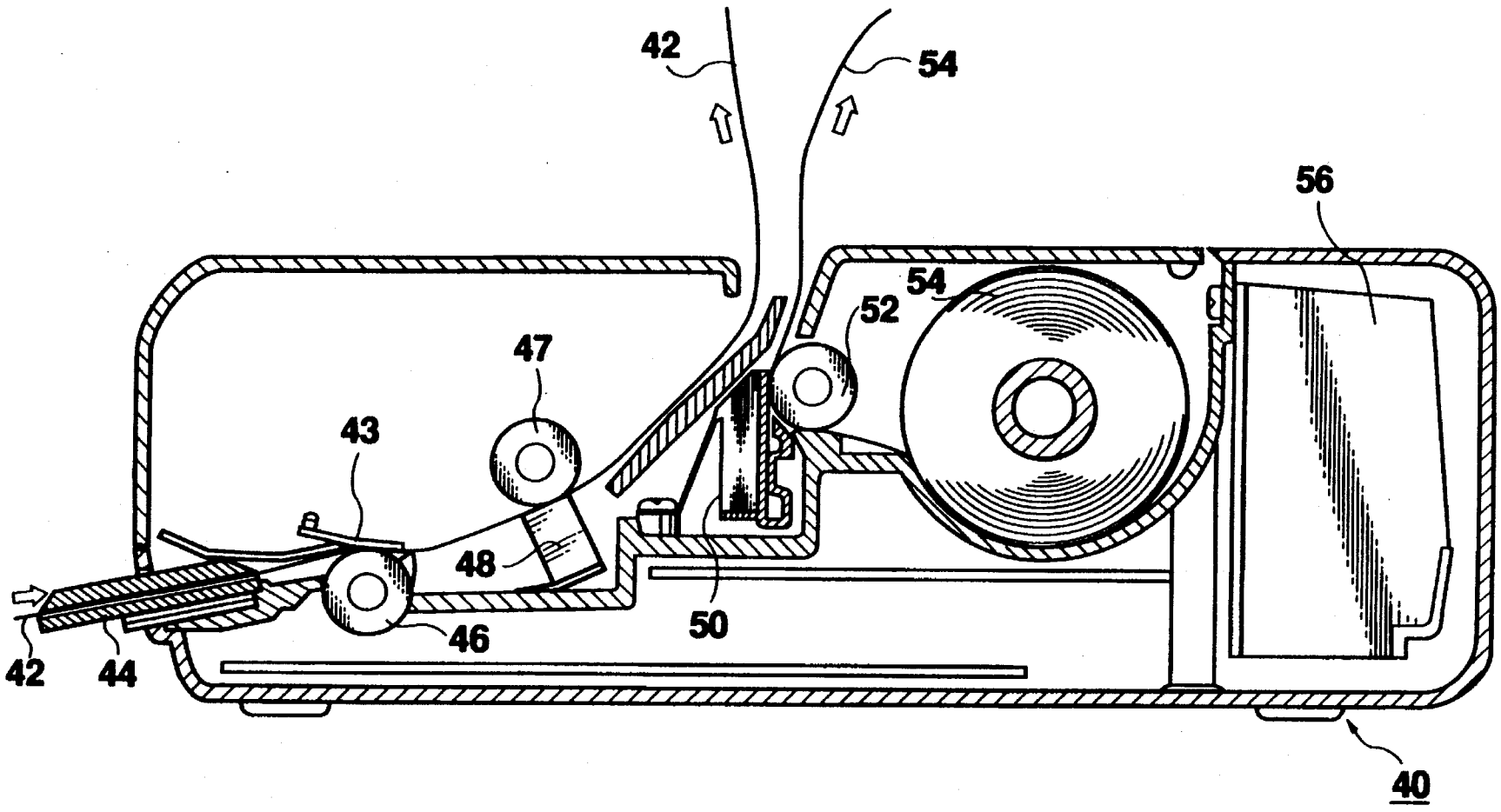
FIG. 7 is a perspective view showing a composition of a printing apparatus equipped with a thermal head according to this invention.

FIG. 7 shows a constitution of a printing apparatus equipped with a thermal head according to this invention. this printing apparatus 40 comprises an insertion opening for inserting a document 42, a feeding roller 46 for feeding the document 42, an image sensor for reading out the contents of the document 42, a printing section 50 for performing the printing operation, and a recording platen roller 52 being adjacent to the printing section 50, and the printing operation is applied on the recording sheet 54. This apparatus operates in response to energy supplying from a power source 56. The printing section 50 is equipped with the thermal head according to this invention.

In this printing apparatus 40, when the document 42 is inserted through the inserting opening 44, the document 42 is individually separated by a separating means 43 to be fed to the image sensor 48. The image sensor 48 converts the pattern on the surface of the document 42 into electric signals, and the printing section 50 performs a printing operation on the recording paper based on the electric signals. Although the present apparatus uses heat sensitive sheet for convenience, it is also possible to use ink ribbon for performing printing on normal sheet. The ink ribbon is suitable particularly for printing on rough paper. Although the shown figure represents a copy or fax machine equipped with a reading mechanism, the thermal head of this invention can be applied to printers not including any reading mechanism. Further, the printing apparatus 40 of this embodiment can be converted into a line printer or serial printer just by changing the printing section 50. When it is set as the line printer, the printing section 50 does not move so as to perform printing by line unit in accordance with the sheet feeding. When it is set as the serial printer, the printing section 50 moves in both the paper feeding direction and the vertical direction. Both types of printers, however, are included in the scope of this invention.

Figure 8A:
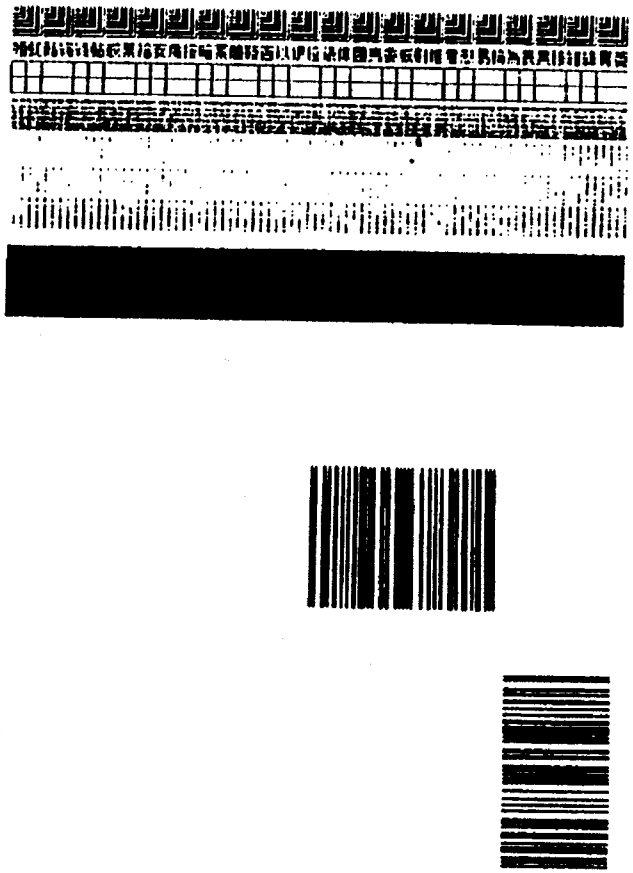
Fig.8(a) PRIOR ART
FIG. 8(*a*) is a view showing a printed example by a conventional thermal head, and FIG. 8(*b*) is a view showing a printed example by a thermal head according to this embodiment.
Figure 8A:
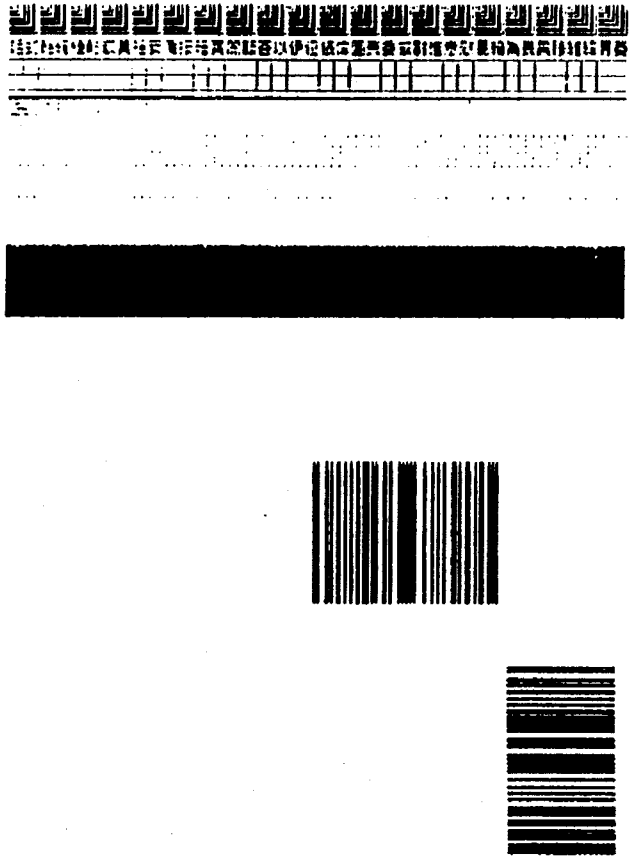
Fig.8(a) PRIOR ART

FIGS. 8(*a*) and 8(*b*) show printed samples of this embodiment and the conventional case, which were made by using the printing apparatus 40 as a line printer. The printing was carried out at the same speed (0.82 msec/line) with thermal history control. As shown in FIGS. 8(*a*) and 8(*b*), in the thermal print head according to this embodiment (FIG. 8(*b*)), the printing quality at this speed is significantly improved. In particular, the side bar of the bar codes appears quite clear without generating any tailing. In the conventional thermal print head (FIG. 8(*a*)), bar code-applicable printing can be carried out if the sheet feeding speed is set to 4 inch/sec, but if it is increased to 6 inch/sec, some tailing arises. In the thermal head of this embodiment, however, the tailing hardly appears even when the sheet is fed at 8 inch/sec so as to provide quite high quality printing. In the thermal head of this embodiment, for reference, the critical speed of generating the tailing is 10 inch/sec. If the printing is carried out at this critical speed in the conventional thermal head, the side lines of the bar codes would be connected to make reading impossible.

In view of the above, according to the thermal head of this invention, since the heat dissipation characteristics are good, and the heat generating area is large, it is possible to attain high speed and high quality printing. In addition, it can be easily manufactured and there are a much lower number of defects in the completed products.

What is claimed is:

1. A thermal print head comprising:

(a) an insulating substrate;

(b) a partial glazed layer formed on a portion of said insulating substrate and having a conical cross-sectional shape;

(c) a heat generating resistor covering both said insulating substrate and said partial glazed layer;

(d) a common electrode and discrete electrodes formed on said heat generating resistor;

(e) a heat generating section in which said heat generating resistor generates heat, said heat generating section being formed on said partial glazed layer; and (f) a protective layer covering said common electrode, said discrete electrodes and said heat generating section;

(g) a lowest part of said partial glazed layer having a width of 0.1 to 0.4 mm, and said partial glazed layer having a peak height of 15 to 25 μm.

2. A thermal print head according to claim 1, wherein said thermal print head is adapted to be heated to a maximum temperature of 300° C. by an electric current and voltage with a pulse width of 0.3 msec and a pulse spacing of 0.62 msec.

3. A thermal print head according to claim 1, wherein the lowest part of said partial glazed layer has a width of 350 μm and said partial glazed layer has a peak height of 20 μm.

4. A thermal print head according to claim 2, wherein said partial glazed layer has a width of 350 μm and a peak height of 20 μm.

5. A printer comprising:

(A) a print unit including a thermal print head having (a) an insulating substrate, (b) a partial glazed layer formed on a portion of said insulating substrate and having a conical cross-sectional shape, (c) a heat generating resistor covering both said insulating substrate and said partial glazed layer, (d) a common electrode and discrete electrodes formed on said heat generating resistor, (e) a plurality of heat generating sections in which said heat generating resistor generates heat, said heat generating sections being formed on said partial glazed layer, (f) a protective layer covering said common electrode, said discrete electrodes and said heat generating sections, and (g) a lowest part of said partial glazed layer having a width of 0.1 to 0.4 mm, and said partial glazed layer having a peak height of 15 to 25 μm;

(B) a power source for supplying electric power to said common and discrete electrodes of said thermal print head; and (C) a paper feed for feeding a sheet of paper to said print unit.

6. A printer according to claim 5, wherein the lowest part of said partial glazed layer has a width of 350 μm and said partial glazed layer has a peak height of 20 μm.

7. A printer according to claim 5, wherein the printer is adapted to be operated with (a) historical heat control, performed at a rate of 0.82 msec/line, and (b) sheets of paper fed at a speed of 8 inch/sec.

8. A thermal print head comprising:

(a) an insulating substrate;

(b) a partial glazed layer formed on a portion of said insulating substrate and having a conical cross-sectional shape;

(c) a heat generating resistor covering both said insulating substrate and said partial glazed layer;

(d) a common electrode and discrete electrodes formed on said heat generating resistor;

(e) a heat generating section in which said heat generating resistor generates heat, said heat generating section being formed on said partial glazed layer; and (f) a protective layer covering said common electrode, said discrete electrodes and said heat generating section;

(g) a lowest part of said partial glazed layer having a width of 0.1 to 0.4 mm, and said partial glazed layer having a peak height of 15 to 25 μm, wherein a ratio of the width of said partial glazed layer to the height of said partial glazed layer is greater than or equal to fifteen.

* * * * *